United States Patent [19]

Brügelmann

[11] Patent Number: 4,730,360

[45] Date of Patent: Mar. 15, 1988

[54] APPARATUS FOR CLEANING TEXTILE SLATS OF VENETIAN BLINDS OR THE LIKE

[76] Inventor: Peter Brügelmann, Isidor-Caro-Strasse 62, D-5000 Köln 80, Fed. Rep. of Germany

[21] Appl. No.: 760,902

[22] Filed: Jul. 31, 1985

[30] Foreign Application Priority Data

Jan. 17, 1985 [DE] Fed. Rep. of Germany ..... 3501320

[51] Int. Cl.[4] ..... A46B 13/04

[52] U.S. Cl. ..... 15/77; 15/102

[58] Field of Search ..... 15/77, 102, 100, 308; 134/9

[56] References Cited

U.S. PATENT DOCUMENTS

| | | | |
|---|---|---|---|
| 1,817,332 | 8/1931 | Worrall | 15/77 |
| 1,930,575 | 10/1933 | Wynd et al. | 15/77 |
| 1,945,274 | 1/1934 | Hormel | 15/102 |
| 1,953,352 | 4/1934 | Kranich | 15/77 |
| 2,282,628 | 5/1942 | Whann et al. | 15/77 |
| 2,313,606 | 3/1943 | Webb et al. | 15/77 |
| 2,380,550 | 7/1945 | Reed | 15/102 X |
| 2,915,423 | 12/1959 | Marini | 15/77 X |
| 2,933,746 | 4/1960 | Frand | 15/77 X |
| 3,047,892 | 8/1962 | McRoberts et al. | 15/77 X |
| 3,643,277 | 2/1972 | Durst | 15/77 |

FOREIGN PATENT DOCUMENTS

| | | |
|---|---|---|
| 3046733 | 7/1982 | Fed. Rep. of Germany . |
| 3211214 | 10/1983 | Fed. Rep. of Germany . |

*Primary Examiner*—Edward L. Roberts

*Attorney, Agent, or Firm*—Birch, Stewart, Kolasch & Birch

[57] ABSTRACT

The invention provides an apparatus by which a thorough cleaning free of wrinkles is achieved for any type of slats (A) in that the lower brush roller (15) of the brush roller pair (14,15) is mounted to dip into a fluid bath (B) in the container box (1) and that the conveyer means comprises cooperating conveyer belt pairs (12,13;16,17) which form with the guide members (23–26) a non-deviating guide channel for the slats (A).

45 Claims, 3 Drawing Figures

FIG. 2
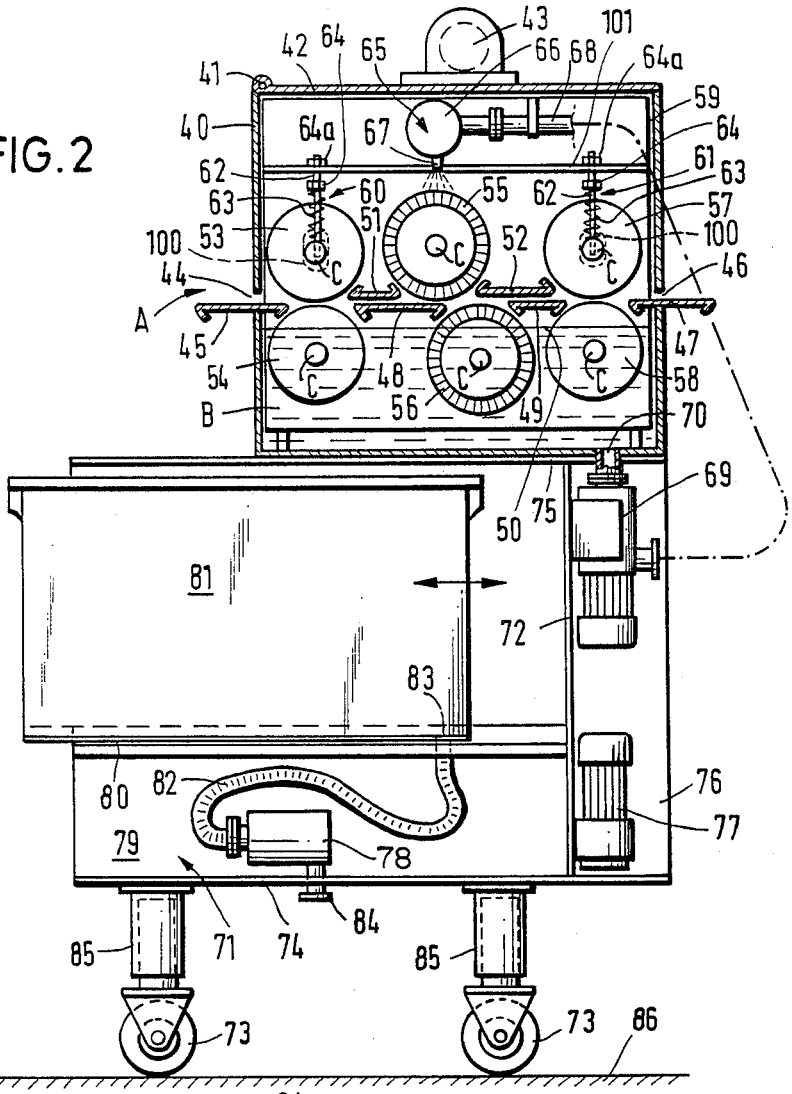
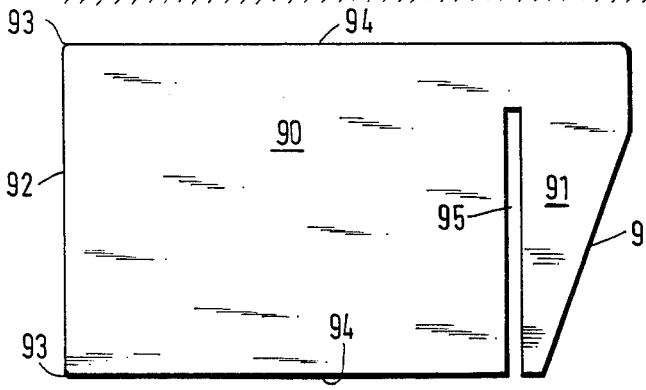
FIG. 3

APPARATUS FOR CLEANING TEXTILE SLATS OF VENETIAN BLINDS OR THE LIKE

The invention relates to an apparatus for cleaning textile slats of Venetian blinds or the like, comprising a fluid-tight container box to house at least one driven brush roller pair, a spraying means for fluid and a conveyer means for the slats. The conveyor means has guide members for guiding the slats and there guide members are arranged at the intake and discharge side of the gap between superposed brush rollers. The fluid of the spraying means is directed against the upper brush roller.

BACKGROUND OF THE INVENTION

Slats for Venetian blinds generally consist of textile strips of a more or less considerable width which are treated with plastics to give to them special features, e.g. a light-shielding effect. One end of each slat is provided with a counterweight while its other end is fitted with a connection member for joining it to a support and adjusting means mounted at the ceiling of the room. The counterweight in the form of a bar or chain may be loosely slipped into a loop of the slat or it may be a loading plate which is welded into the slat material. Contaminated slats need to be cleaned with fluid and it is necessary for the plastic material to remain on the textile material to maintain the uniform light-shielding effect. Further, during the washing operation, the slat should not be kinked. Kinks are not only unattractive, but they also might cause the formation of cracks. Because of these requirements, slats cannot be washed in a washing machine Thus, special devices have been developed for their cleaning.

The apparatus mentioned above for cleaning textile slats of Venetian blinds (DE-OS No. 30 46 733) comprises a number of stations in which the slats are prewashed, clear-washed, and flush-cleaned. The conveyer means used are conveyer roller pairs which shift the slats to the brush roller gap and removing them therefrom respectively. However, the use of conveyer roller pairs necessitates certain rigidity of the slats to ensure that they are passed to and removed from the brush roller pairs in a smooth and non-creased condition. However, with soft, flexible slats, a crease-free passage through the gaps of conveyer- and brush rollers cannot be guaranteed, because the slats are not adequately guided and held during their passage through the assembly. Besides, cleaning of the slats in the known device is insufficient since fluid is sprayed only on the upper brush roller of a pair of brush rollers, while the lower brush roller remains substantially dry so that in the three stations, only the slat top side is wetted with fluid while the underside may be simply brush-treated.

In another known cleaning device (German OS No. 32 11 214), both brush rollers of a brush roller pair are dipped into a fluid bath in the container box so that the slats traverse the fluid bath whereby the cleaning effect is improved. However, it is necessary to trail the slats through the container box. Therefore, said slats need be provided with a loop for connection of a rod-shaped holding element of the conveyer means. Slats incorporating a welded loading plate are not provided with such a loop and therefore, may not be conveyed through said means. Further, because of the lack of guides, the smooth passage of soft slats through the brush roller pair is not assured and problems may arise.

SUMMARY OF THE INVENTION

It is the object of the invention to improve an apparatus for cleaning textile slats of Venetian blinds or the like of the foregoing type so that a thorough and crease-free cleaning of any type of slats is effected.

According to the invention, said problem is solved by a the lower brush roller of the brush roller pair being mounted so as to dip into a fluid bath in the container box and by the conveyer means comprising cooperating conveyer belt pairs which, together with the guide members, form a linear guide channel for the slats.

One advantage of said design, is that the upper brush roller is wetted by spraying while the lower brush roller is wetted due to its rotation in the fluid bath. The slat passing through the gap between the two brush rollers is treated by wet brushes on both its top face as well as on its underside, so that an intense cleaning is realised. The conveyer means consisting of cooperating conveyer belt pairs and the guide members form a non-deviating guide channel for the slats which are held and guided in a smooth condition. At the same time, soft slats sensitive to creases are introduced between the brush rollers which accept them to discharge them from the device without kinks. Slats of any stability, length or end configuration may be cleaned quickly to their pore depth and may be cleaned without being creased according to the apparatus of the invention. A number of cleaning stations within the container box are unnecessary so that the construction of the apparatus may be compact.

According to one embodiment of the invention, the brush rollers are mutually offset in the conveying direction and the guide members comprise upper and lower guide plates situated closely adjacent to the brush rollers and to the conveyer belt pairs. The upper brush roller is displaced towards the slat inlet of the device. The periphery of each brush roller contacts the plane of the straight guide channel because its axis is situated on the straight line of the conveyer belt roller axes. Each brush roller is operated against a guide plate thus causing an improved cleaning effect with respect to the supported slats.

One conveyer belt pair each may be mounted upstream. With this design, downstream of a brush roller pair and it is suitable for the downstream conveyer belt pair to be operated at a higher rotational speed than the brush roller pair. By this means, the slats to be cleaned are subjected to tension in the conveying direction and their straight, kink-free passage through the device is assisted. The rotational speed of the brush roller pair is many times (preferably about five times) higher than that of the conveyer belt pairs. Due to such an increased rotational speed, the cleaning effect is favorably enhanced because the slats are intensely brushed on the top and bottom sides as they move slowly through the brush roller pair. The thorough cleaning is additionally improved because each brush roller is provided with short scrubbing bristles, preferably natural bristles.

The above-noted cleaning problems may be further solved as the lower brush roller of the brush roller pair is mounted so as to dip into a fluid bath in the container box. Also at the upstream ends and downstream of the brush roller pair, the conveyer means comprises one conveyer roller pair each whose roller gaps are in straight alignment with the roller gap of the brush roller pair. This design plus the feature of the two upper conveyer rollers being loaded by a spring means aids cleaning of the slats and helps prevent kinking them.

This design of the apparatus permits a compact construction having a length of about 1.10 m, because only two conveyer roller pairs and one sole brush roller pair between them are provided. The cleaning effect of this assembly is excellent because the lower brush roller of the sole brush roller pair is dipped into the fluid bath, and, in conjunction with the sprayed upper brush roller, the moisture transfer with the simultaneous brushing effect on the upper and underside of the passing slats is sufficient. Due to the spring means of the two upper conveyer rollers, each conveyer roller gap may freely accept and convey the soft slats without causing an excessive contact pressure which would result in a creasing or locking of the slats in the roller gap. Conveniently, the spring means includes an adjustable coil spring arrangement engaging the vertically movable shaft of each upper conveyer roller, thus permitting adjustment for the slats under treatment. The guide members between the conveyer roller pairs and the brush roller pair are responsible for the rectilinear guiding of the slats along the straight path between the aligned roller gaps. By avoiding any deviation of the crease-sensitive soft textile slats, the latter may leave the machine in a completely smooth condition.

However, if the slats are so soft that their straight, smooth and creaseless passage through the machine cannot be absolutely guaranteed, it is recommendable that they be suspended in their endsided loop by a guide plate which, as a solid head portion, trails them through the device.

Suitably, the shafts of the brush roller pair and of the two conveyer roller pairs are supported in side parts of a frame structure removably mounted in the container box. This removable mounting permits access from outside the container box for maintenance or repair.

According to an advantageous embodiment of the invention, the container box is detachably provided on a travelling underframe in which a vessel for cleaning fluid is positioned. Rails are provided on the from the underframe of the vessel so that the slats soaked in the vessel may be fed directly to the overlying assembly. The slats are precleaned by being soaked in the vessel. The fluid bath in the container box of the device should contain only water and, if necessary, a rinsing agent additive. The spraying means directed against the upper brush roller is supplied with fluid from fluid bath by means of a circulating pump, thus bringing about a closed fluid cycle independent of local water supplies. As the fluid bath in the container box is substantially free from detergent additives, the circulating system is adapted to operate free of troubles over long periods. It is suitable to house the circulating pump in the underframe and to connect it to the spraying means by hose conduits. The device and the underframe form a compact unit which, by a motor vehicle, may be easily moved to the place of operation in buildings. The unit which is narrower than normal room doors may be perfectly set up at any operational site.

Further scope of applicability of the present invention will become apparent from the detailed description given hereinafter. However, it should be understood that the detailed description and specific examples, while indicating preferred embodiments of the invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 3 shows a plan view of a guide plate for slats.

DESCRIPTION OF THE PREFERRED EMBODIMENTS

Figure 1:
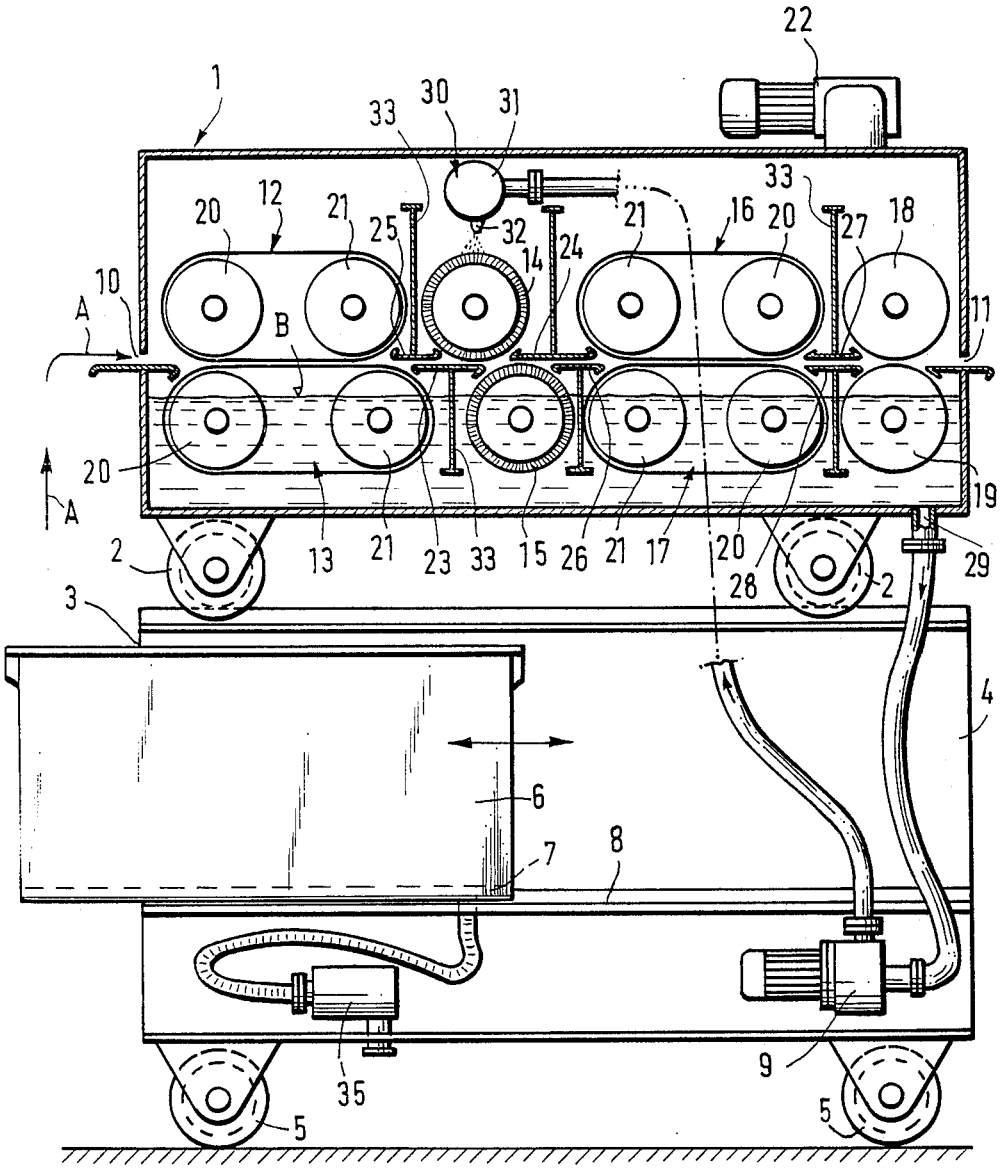
FIG. 1 is a schematic side view of the apparatus comprising conveyer belt pairs, FIG. 2 schematically illustrates a second embodiment including two conveyer roller pairs.

The device according to FIG. 1 substantially comprises a fluid-tight square-shaped container box 1 mounted on wheels 2 on a horizontal frame 3 of an underframe 4 which is movable by wheels 5. The width and length dimensions of the container box 1 and of the underframe 4 are nearly equal. The underframe 4, however, being somewhat higher than the container box 1 in order to permit it to house therein a big vessel 6, e.g. of plastics which contains the cleaning fluid for soaking the contaminated slats. The vessel 6 is located on a support 7 which, by means of a rail guide 8, may be withdrawn or pushed forward along the two longitudinal sides of the underframe 4. On this underframe 4, there is a waste water pump 35 connected to the vessel 6 and a circulating pump 9.

Both longitudinal sides of the underframe 4 are lined with plates. The side opposite the withdrawal end of the vessel 6 may be closed by a door.

One narrow side in the lower half of the container box 1 comrpises an introductory slot 10 for plecleaned slats A from the vessel 6, its opposite narrow side comprising in alignment with the mentioned slot an exit slot 11 for cleaned slats A. The introductory slot 10 is provided at the side from which the vessel 6 is withdrawn from the underframe 4. A straight guide channel for slats A provided between the introductory slot 10 and the exit slot 11 extends between an upper conveyer belt 12 and a lower conveyer belt 13, an upper brush roller 14 and a lower brush roller 15, an upper conveyer belt 16 and a lower conveyer belt 17 as well as an upper squeezing roller 18 and a lower squeezing roller 19.

The guide channel additionally includes upper and lower guide plates 23,24, and 25,26 as well as 27,28 intermediate the inlet- and outlet sides of the gaps between the conveyer belt pairs 12,13; 16,17 and the brushing roller pair 14,15 or the squeezing roller pair 18,19. The conveyer belts 12,13,16,17 may either consist of one sole, endless belt or of a plurality of juxtaposed, continuous belts rotating around the rollers 20,21 and whose mutually contacting strands convey slats A smoothly and free of creases to and away from the brush rollers 14, 15. A motor 22 mounted on top of the container box 1 is used to drive the conveyer belts 12,13,16,17 and the brush rollers 14 and 15. The drive being effective for the two inner rollers 21 of each conveyer belt 12,13,16,17, as well as for the two brush rollers 14,15 and for the two squeezing rollers 18,19. Due to an adequate gearing, the speed of the brush rollers 14,15 is about five times higher than that of rollers 21, while the peripheral speed of the conveyer belt pair 16,17 is higher than that of the conveyer belt pair 12,13. These different speeds will result in tension being applied to the slats A.

The axes of rotation of all rollers 20,21, brush rollers 14,15 and squeezing rollers 18,19 are situated in one respective common plane on a straight line. The upper brush roller 14 and the lower brush roller 15 are offset in conveying direction so that the upper brush roller 14 is somewhat closer to the introductory slot 10, while the lower brush roller 15 is situated near the exit slot 11. The upper and lower roller 21 of the front conveyer belt pair 12,13 are offset correspondingly. The offset causes brush rollers 14,15 to operate each against one lower or one upper guide plate 23,24 which, in common with opposite guide plates 25,26, form the guide channel for the slats A between the brush rollers 14,15 and the conveyer belts 12,13, on the one hand, and 16,17, on the other hand. The guide plates 23–28 may consist of smooth sheet fixed at holdings 33 and being sufficiently long so that slats A are guided smoothly and free of creases from the outlet of the first conveyer belt pair 12,13 into the gap of the brush roller pair 14,15 and from there into the inlet of the second conveyer belt pair 16,17. Guide plates 27,28 are responsible for the corresponding transmission from the outlet of the second conveyer belt pair 16,17 to the inlet of the squeezing roller pair 18,19.

The brush rollers 14,15 are provided with short scrubbing bristles of an excellent brushing effect, the cleaning action of the brushes being intensified due to the fact that the lower brush roller 15 partly dips into a fluid bath B whose level is beneath the plan between introductory slot 10 and of the exit slot 11 container box 1. The fluid bath B comprises water and a rinsing agent additive. By pump 9, the water is pumped in a closed cycle through a discharge port 29 to a spraying means 30 consisting of a tube 31 arranged above and in parallel to brush rollers 14 and containing a number of nozzle openings 32 directed against said brush roller 14. Alternatively, it is possible to provide a continuous longitudinal slot in the tube 31 instead of nozzle openings 32. Since both brush rollers 14 and 15 are wetted, they may carefully clean the slats A to the depth of their pores. Also soft slats are conveyed free of wrinkles and without interruption through the container box 1 by the conveyer belt pairs 12,13 and 16,17.

The squeezing roller pair 18,19 at the end of the conveyer path is adapted to squeeze liquid from the slats A which, upon leaving the exit slot 11. The slats are still wet but are not dripping wet. The wet slats which are subsequently provided with their suspension fittings and, if necessary, with loading means, will be then suspended accordingly.

The apparatus according to FIG. 2 is of a more compact design than that of FIG. 1. It comprises a short fluid-tight container box 40 having an upper cover 42 swivelling about a joint 41 and adapted to support a mounted drive 43. On a lower half of one side wall of the container box 40, there is provided an introductory slot 44 for precleaned slats A in which a lower guide plate 45 is fitted to extend partly into the container. The opposite side wall of the container box 40 comprises in alignment with the introductory slot 44 an exit slot 46 which also contains a lower guide plate 47 extending from the inside of the container box 40 to the outside. The lower guide plates 45 and 47 are positioned in the same plane, their surfaces being supplemented by two additional guide plates 48,49 situated inside the container box 40 above the level 50 of the fluid bath B. Said lower guide plates 48,49 are supplemented by oppositely mounted upper guide plates 51,52 to form with them a guide channel for the slats A which extends rectilinearly from the introductory slot 44 intermediate the roller gaps to the exit slot 46. The roller gaps are situated between a front pair of conveyer rollers 53,54, a central pair of brush rollers 55,56 and a rear pair of conveyer rollers 57,58 of the diameters of which are substantially equal. Shafts C of the six rotating rollers 53–58 are supported in a frame structure 59. Upon removal of interfering elements and upon opening of the cover 42, these rollers may be lifted out of the container box 40 to allow repair, cleaning or any other maintenance work. The guide plates 48,49,51 and 52 are fixed at the frame structure 59 as well. The shafts C of the conveyer rollers 53,54 and 57,58 of each conveyer roller pair are superposed in perpendicular direction while the shafts C of the brush rollers 55,56 are mutually offset so that the upper brush roller 55 is placed more closely to the upper conveyer roller 53 while the lower brush roller 56 is displaced towards the lower conveyer roller 58.

The shafts C of the two upper conveyer rollers 53 and 57 are mounted to be liftable and lowerable in vertical or inclined elongated holes 100 in the side walls of the frame structure 59. They are loaded correspondingly by coil spring arrangements 60,61 which each consist of a vertically upwardly directed bar 62 held in a horizontal stem 101 of the frame structure 59 by means of a nut **64*a* fixed by screwing, the bar being encompassed by a coil spring 63. The tension force of each coil spring 63 is adjustable by a nut 64 screwed on the threaded end of bar 62**.

While the lower brush roller 56 rotates in the fluid bath B into which it is dipped by about $\frac{2}{3}$ of its diameter, the upper brush roller 55 is wetted by a spraying means 65 consisting of a tube 66 having downwardly directed nozzle openings 67 and extending in parallel to the upper brush roller 55 over about the same length therewith. The nozzle openings 67 are directed vertically or obliquely against the upper brush roller 55. Via a conduit 68, the tube 66 communicates with a circulating pump 69 which, through a connecting line 70 in the bottom range of the container box 40 pumps the fluid bath B in a closed cycle.

The circulating pump 69 is fixed at a vertical inner wall 72 of an underframe 71 movable on wheels 73, the underframe 71 being box-shaped and composed of a bottom 74, an upper plate 75 as well as of two side walls 76. The two side walls 76 extend beyond the inner wall 72 to form a chamber for the circulating pump 69 and for a drive motor 77. This drive motor drives the two conveyer roller pairs 53,54; 57,58 and the brush roller pair 55,56 by endless belts (not shown). All of the electrical components are short-distance wired behind the inner wall 72 in the chamber which is optionally open at its end side. A small waste-water pump 78 mounted on the bottom 74 of the underframe 71 is provided in a space 79 beneath the rail guidance 80 for a vessel 81 which contains cleaning fluid for soaking the contaminated slats A. To introduce and remove the slats A, the vessel 81 is somewhat moved forward on the rail guidance 80 out of the underframe 71. Via a hose 82, the pump 78 is connected to a bottom terminal 83 of the vessel 81 to pump the waste water from the vessel 81 through an outlet 84 and a non-drafted hose. To illustrate clearly the inside fittings of the underframe 71, the front side wall 76 of the underframe 71 is removed in the drawing.

Since, unlike the embodiment of FIG. 1, the bottom of the container box 40 is placed directly on the upper plate 75 of the underframe 71, the arrangement in portable condition is relatively low, so that the removal of the soaked slats from vessel 81 and their introduction into the slot 44 may be rather unhandy for the operators. To overcome this situation, the bottom 74 of the underframe 71 is provided with four columns 85 which are hydraulically adjustable in length to lift the total device relative to the floor 86 as needed.

If the textile slats A to be cleaned are so soft that their straight, creaseless passage through the roller gaps of the conveyer roller pairs and of the brush roller pair cannot be guaranteed, a rigid metallic guide plate 90 with a hook 91 is suspended in the loop fitted at the end of each slat, the shape of said guide plate 90 being rectangular and flat. Its straight front edge 92 extending via rounded corners 93 into the longer straight lateral edges 94. One end of the guide plate 90 comprises a transverse slot 95 extending in vertical direction to the lateral edges 94 and being open at one end while its other end is spaced from the opposite lateral edge 94 thus forming the hook 91. The slot 95 is defined by parallel edges and it is broad enough to receive the slat material.

To facilitate the introduction of the hook 91 into the slat loop, the front border of the hook 91 may be inclined as shown by reference numeral 96.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Apparatus for cleaning textile slats of Venetian blinds or the like comprising:

a fluid-tight box containing a fluid bath, said box housing at least one driven brush roller pair having an upper brush roller and a lower brush roller mounted so as to form a gap thereinbetween for slats to pass therethrough, said gap having an intake side and a discharge side, said lower brush roller being mounted to dip into the fluid bath in the box;

spray means for directing fluid against the upper brush roller;

conveyor means for advancing slats, said conveyor means having a pair on conveyor belt pairs, a first pair of conveyor belts being mounted upstream of the brush roller pair and the second pair of the conveyor belts being mounted downstream of the brush roller pair, each pair of conveyor belts having a peripheral speed, the peripheral speed of the downstream conveyor belts being higher than the peripheral speed of the upstream conveyor belts; and guide members for guiding slats, said guide members being arranged at the intake and discharge sides of the gap, said guide members cooperating with said conveyor belt pairs to form a linear guide channel for slats.

2. Apparatus according to claim 1, characterized in that the speed of rotation of the brush roller pair is many times, preferably five times higher than that of the conveyer belt pairs.

3. Apparatus according to claim 1, characterized in that the brush rollers are offset relative to one another in conveying direction and that the guide members include upper and lower guide plates which are closely adjacent to the brush rollers and to the roller gaps of the conveyer means.

4. Apparatus according to claim 1, characterized in that each brush roller has short scrubbing bristles, preferably natural bristles.

5. Apparatus according to claim 1, characterized in that a circulating pump feeds fluid from the fluid bath to the spraying means.

6. Apparatus for cleaning slats or the like comprising:

a housing having an introductory slot and an exit slot for receiving and discharging slats, respectively;

conveyor means for advancing slats through the housing from said introductory slot to said exit slot;

at least one pair of driven roller brush means for scrubbing slats advanced through said housing, said at least one pair of driven roller brush means including upper brush means and lower brush means spaced relative to each other for slats to pass thereinbetween, said at least one pair of driven roller bursh means having a forward side and a rearward side;

nonrotatable guide means for guiding slats, said guide means being located at least at the forward side and the rearward side of said at least one pair of driven roller brush means;

fluid spray means operatively positioned relative to said upper brush means for wetting said upper brush means;

wherein said conveyor means, said guide means, said upper brush means, said lower brush means, said introductory slot and said exit slot all forming a linear guide channel through which the slats move in a substantially straight line path;

a portable underframe for mounting said housing; and a vessel for cleaning fluid, said vessel being movably mounted on rails located on said underframe.

7. Apparatus according to claim 6, wherein said conveyor means comprises:

a first conveyor belt pair mounted upstream of said nonrotatable guide means mounted at least at the forward side of said at least one pair of driven roller brush means;

a second conveyor belt pair mounted downstream of said nonrotatable guide means mounted at least at the rearward side of said at least one pair of driven roller brush means; and said first and second conveyor belt pairs continuing said linear guide channel through which slats move in a substantially straight line path.

8. Apparatus according to claim 7, wherein said first and said second conveyor belt pairs each have a peripheral speed and said peripheral speed of the second conveyor belt pair is higher than the peripheral speed of the first conveyor belt pair.

9. Apparatus according to claim 8, wherein said at least one pair of driven roller brush means have a speed of rotation and said speed of rotation is higher than the peripheral speed of each of the conveyor belt pairs.

10. Apparatus according to claim 9, wherein said speed of rotation of said at least one pair of driven roller brush means is five times higher than the peripheral speed of said second conveyor belt pair.

11. Apparatus according to claim 6, wherein said conveyor means comprises;

a first pair of conveyor roller means mounted upstream of said nonrotatable guide means mounted at least at the forward side of said at least one pair of driven roller brush means;

a second pair of conveyor roller means mounted downstream of said nonrotatable guide means mounted at least at the rearward side of said at least one pair of driven roller brush means; and said first and second pairs of conveyor roller means continuing said linear guide channel through which slats move in a substantially straight line path.

12. Apparatus according to claim 11 and further comprising:

a first vertical shaft for adjustably mounting one of said first pair of conveyor roller means to said housing;

a second vertical shaft for adjustably mounting one of said second pair of conveyor roller means to said housing; and first spring means mounted on the first vertical shaft and second spring means mounted on the second vertical shaft, said first and second spring means aiding vertical adjustment of said first and second pair of conveyor roller means.

13. Apparatus according to claim 12 and further including a frame structure removably mounted within said housing, said first and said second vertical shafts being supported on said frame structure.

14. Apparatus according to claim 6, wherein the upper brush means and lower brush means of said at least one pair of driven roller brush means each have short, natural, scrubbing bristles.

15. Apparatus according to claim 6 and further comprising:

four adjustable columns attached beneath the underframe, said four columns being raised and lowered to adjust the height of the underframe and the housing mounted thereon.

16. Apparatus according to claim 15 and further comprising:

a fluid bath contained within said housing; and a circulating pump being in communication with said fluid bath for feeding fluid to said fluid spray means.

17. Apparatus according to claim 16 and further including a waste fluid pump for withdrawing fluid from said fluid bath, said waste fluid pump and said circulating pump each being contained in said underframe.

18. Apparatus for cleaning slats or the like having an upper surface and a lower surface comprising:

a housing;

conveyor means for advancing slats through the housing;

a fluid bath being contained within said housing;

at least one pair of driven roller brush means for scrubbing slats advanced through said housing, said at least one pair of driven roller brush means including an upper and a lower roller brush spaced relative to each other for slats to pass thereinbetween, said at least one pair of driven roller brush means having an inlet side and an outlet side;

guide means for guiding slats, said guide means being located at least on said inlet side and said outlet side of said at least one pair of driven roller brush means;

fluid spray means for wetting said upper roller brush for cleaning an upper surface of a slat and said lower roller brush being mounted to partially rotate through said fluid bath contained in said housing for cleaning a lower surface of a slat;

a portable underframe for mounting said housing; and a vessel for cleaning fluid, said vessel being movably mounted on rails located on said underframe.

19. Apparatus according to claim 18, wherein said conveyor means comprises:

a first conveyor belt pair mounted upstream of said guide means located at least at the inlet side of said at least one pair of driven roller brush means;

a second conveyor belt pair mounted downstream of said guide means located at least at the outlet side of said at least one pair of driven roller brush means; and said first and second conveyor belt pairs, said guide means and said at least one pair of driven roller brush means all form a linear guide channel through which slats move in a substantially straight line path.

20. Apparatus according to claim 19, wherein said first and second conveyor belt pair each have a peripheral speed and said peripheral speed of the second conveyor belt pair is higher than the peripheral speed of the first conveyor belt pair.

21. Apparatus according to claim 20, wherein said at least one pair of driven roller brush means have a speed of rotation and said speed of rotation is higher than the peripheral speed of each of the conveyor belt pairs.

22. Apparatus according to claim 21, wherein said speed of rotation of said at least one pair of driven roller brush means is five times higher than the peripheral speed of said second conveyor belt pair.

23. Apparatus according to claim 18, wherein said conveyor means conprises:

a first pair of conveyor roller means mounted upstream of said guide means located at least at the inlet side of said at least one pair of driven roller brush means;

a second pair of conveyor roller means mounted downstream of said guide means located at least at the outlet side of said at least one pair of driven roller brush means; and said first and second pairs of conveyor roller means, said guide means and said at least one pair of driven roller brush means all form a linear guide channel through which slats move in a substantially straight line path.

24. Apparatus according to claim 23 and further comprising:

a first vertical shaft for adjustably mounting one of said first pair of conveyor roller means to said housing;

a second vertical shaft for adjustably mounting one of said second pair of conveyor roller means to said housing; and first spring means mounted on the first vertical shaft and second spring means mounted on the second vertical shaft, said first and second spring means aiding vertical adjustment of said first and second pair of conveyor roller means.

25. Apparatus according to claim 24 and further including a frame structure removably mounted within said housing, said first and second vertical shafts being supported on said frame structure.

26. Apparatus according to claim 18, wherein the upper brush and the lower brush means of said at least one pair of driven roller brush each have short, natural, scrubbing bristles.

27. Apparatus according to claim 18 and further comprising;

four adjustable columns attached beneath the underframe, said four columns being raised and lowered to adjust the height of the underframe and the housing mounted thereon.

28. Apparatus according to claim 27 and further comprising:

a circulating pump being in communication with said fluid bath for feeding fluid to said fluid spray means.

29. Apparatus according to claim 28 and further including a waste fluid pump for withdrawing fluid from said fluid bath, said waste fluid pump and said circulating pump each being contained in said underframe.

30. Apparatus for cleaning slats or the like comprising:

a housing;

conveyor means for advancing slats through the housing;

a fluid bath being contained within said housing;

at least one pair of driven roller brush means for scrubbing slats advanced through said housing, said at least one pair of driven roller brush means including an upper and a lower roller brush spaced relative to each other for slats to pass thereinbetween, each of said upper and lower roller brushes having a forward side and a rearward side, said upper roller brush having a first axis of rotation, said lower roller brush having a second axis of rotation, said first axis being horizontally offset from said second axis in order to aid cleaning of said slats and to avoid possible deformation of said slats, and the rearward side of said upper roller brush being positioned downstream from the forward side of said lower roller brush;

guide means for guiding slats, said guide means being located at least on the forward side and on the rearward side of the roller brushes, said first axis being located above a first portion of said guide means and said second axis being located below a second portion of said guide means, said portions of said guide means being positioned so as to permit said roller brush means to cooperate with said portions and to scrub said slats without possibly deforming said slats; and fluid spray means operatively positioned relative to said upper bursh for wetting said upper brush.

31. Apparatus according to claim 30, wherein said conveyor means comprises:

a first conveyor belt pair mounted upstream of said guide means located at least on said forward side of said roller brushes;

a second conveyor belt pair mounted downstream of said guide means located at least on said rearward side of said roller brushes; and said first and second conveyor belt pairs, said guide means and said at least one pair of driven roller brush means all form a linear guide channel through which slats move in a substantially straight line path.

32. Apparatus according to claim 31, wherein said first and second conveyor belt pairs each have a peripheral speed and said peripheral speed of the second conveyor belt pair is higher than the peripheral speed of the first conveyor belt pair.

33. Apparatus according to claim 32, wherein said at least one pair of driven roller brush means have a speed of rotation and said speed of rotation is higher than the peripheral speed of each of the conveyor belt pairs.

34. Apparatus according to claim 33, wherein said speed of rotation of said at least one pair of driven roller brush means is five times higher than the peripheral speed of said second conveyor belt pair.

35. Apparatus according to claim 30, wherein said conveyor means comprises:

a first pair of conveyor roller means mounted upstream of said guide means located at least at the forward side of said roller brushes;

a second pair of conveyor roller means mounted downstream of said guide means located at least at the rearward side of said roller brushes; and said first and second pairs of conveyor roller means, said guide means and said at least one pair of driven roller brush means all form a linear guide channel through which slats move in a substantially straight line path.

36. Apparatus according to claim 35 and further comprising:

a first vertical shaft for adjustably mounting one of said first pair of conveyor roller means to said housing;

a second vertical shaft for adjustably mounting one of said second pair of conveyor roller means to said housing; and first spring means mounted on the first vertical shaft and second spring means mounted on the second vertical shaft, said first and second spring means aiding vertical adjustment of said first and second pair of conveyor roller means.

37. Apparatus according to claim 36 and further including a frame structure removably mounted within said housing, said first and second vertical shafts being supported on said frame structure.

38. Apparatus according to claim 30, wherein the upper roller brush means and the lower roller brush of said at least one pair of driven roller brush means each have short, natural, scrubbing bristles.

39. Apparatus according to claim 30 and further comprising:

a portable underframe for mounting said housing; and a vessel for cleaning fluid, said vessel being movably mounted on rails located on said underframe.

40. Apparatus according to claim 39 and further comprising:

four adjustable columns attached beneath the underframe, said four columns being raised and lowered to adjust the height of the underframe and the housing mounted thereon.

41. Apparatus according to claim 40 and further comprising:

a circulating pump being in communication with said fluid bath for feeding fluid to said fluid spray means.

42. Apparatus according to claim 41 and further including a waste fluid pump is provided for withdrawing fluid from said fluid bath, said waste fluid pump and said circulating pump each being contained in said underframe.

43. Apparatus for cleaning slats or the like having an upper surface and a lower surface comprising:

a housing having an introductory slot and an exit slot for receiving and discharging slats, respectively;

conveyor means for advancing slats through the housing from said introductory slot to said exit slot;

a fluid bath being contained within said housing;

at least one pair of driven roller brush means for scrubbing slats advanced through said housing, said at least one pair of driven roller brush means including an upper and a lower roller brush spaced relative to each other for slats to pass thereinbetween, said at least one pair of driven roller brush means having an inlet side and an outlet side, each of said upper and lower brushes having a forward side and a rearward side, said upper roller brush having a first axis of rotation, said lower roller brush having a second axis of rotation, said first axis being horizontally offset from said second axis in order to aid cleaning of said slats and to avoid possible deformation of said slats, and the rearward side of said upper roller brush being positioned downstream from the forward side of said lower roller brush;

nonrotatable guide means for guiding slats, said guide means being located at least at the inlet side and the outlet side of said at least one pair of driven roller brush means, said first axis being located above a first portion of said guide means and said second axis being located below a second portion of said guide means, said portions of said guide means being positioned so as to permit said roller brush means to cooperate with said portions and to scrub said slats without possibly deforming said slats; and fluid means for wetting said upper surface of a slat and said lower roller brush being mounted to partially rotate through said fluid bath contained in said housing for cleaning a lower surface of a slat;

wherein said conveyor means, said guide means, said upper brush, said lower brush, said introductory slot and said exit slot all forming a linear guide channel through which the slats move in a substantially straight line path.

44. Apparatus for cleaning textile slats of Venetian blinds or the like comprising:

a housing containing a fluid bath, said housing containing at least one driven brush roller pair having an upper brush roller and a lower brush roller mounted so as to form a gap thereinbetween for slats to pass therethrough, said gap having an intake side and a discharge side, said lower brush roller being mounted to dip into the fluid bath in the housing;

spray means for directing fluid against the upper brush roller;

conveyor means for advancing slats, said conveyor means having at least one conveyor belt pair;

guide members for guiding slats, said guide members being arranged at intake and discharge sides of the gap, said guide members cooperating with said at least one conveyor belt pair to form a linear guide channel for slats;

a portable underframe for mounting said housing, said underframe having rails; and a vessel for cleaning fluid removably mounted on the rails located on said underframe.

45. Apparatus according to claim 44, and further comprising:

four adjustable columns attached beneath the underframe, said four columns being raised and lowered to adjust the height of the underframe and the housing mounted thereon.

* * * * *